US011684105B2

(12) United States Patent
Mustac

(10) Patent No.: US 11,684,105 B2
(45) Date of Patent: Jun. 27, 2023

(54) GOALIE HELMET

(71) Applicant: ZZM Enterprises, LLC, Woodbury, NJ (US)

(72) Inventor: Michael A. Mustac, West Deptford, NJ (US)

(73) Assignee: ZZM Enterprises, LLC, Woodbury, NJ (US)

( * ) Notice: Subject to any disclaimer, the term of this patent is extended or adjusted under 35 U.S.C. 154(b) by 8 days.

(21) Appl. No.: 16/906,750

(22) Filed: Jun. 19, 2020

(65) Prior Publication Data

US 2020/0315281 A1 Oct. 8, 2020

Related U.S. Application Data

(63) Continuation-in-part of application No. 15/014,214, filed on Feb. 3, 2016, now Pat. No. 10,709,193.

(51) Int. Cl.
*A42B 3/20* (2006.01)
*A42B 3/08* (2006.01)

(52) U.S. Cl.
CPC ..... *A42B 3/205* (2013.01); *A42B 3/08* (2013.01); *A42B 3/20* (2013.01)

(58) Field of Classification Search
CPC ..... A42B 3/08; A42B 3/0205; A42B 3/0283; A42B 3/085; A42B 3/14; A42B 3/142; A42B 3/145; A42B 3/147; A42B 3/20; A42B 3/10; A42B 3/105; A42B 3/12; A42B 3/121; A42B 3/124; A42B 3/125; A42B 3/127; A42B 3/128; A42B 3/00; A63B 71/10; A61F 9/06; A61F 9/061; A61F 9/062; A61F 9/064; A61F 9/065; A61F 9/067; A61F 9/068
(Continued)

(56) References Cited

U.S. PATENT DOCUMENTS 2,739,309 A 3/1956 Frieder et al.
2,926,355 A 3/1960 Finken
(Continued)

OTHER PUBLICATIONS

International Preliminary Report on Patentability from corresponding PCT International Application No. PCT/US2021/036101 dated Dec. 29, 2022.
(Continued)

*Primary Examiner* — F Griffin Hall
(74) *Attorney, Agent, or Firm* — DLA Piper LLP (US)

(57) ABSTRACT

A helmet for a goalie is described herein. The helmet includes a head protective outer shell, a chin cup support bracket, and a shock membrane. The head protective outer shell defines an interior space. The head protective outer shell includes an exterior portion and in interior portion. The exterior portion includes an exterior lower section and an exterior upper section. The exterior upper section is curved. The interior portion is opposite the exterior portion. The interior portion includes an interior lower section and an interior upper section. The chin cup support bracket is secured to the interior lower section. The chin cup support bracket includes dual arm members configured to interface with a removable chin cup. The shock membrane is coupled with the interior upper section. The shock membrane includes a honeycomb design adapted to match a curvature of the exterior upper section and the interior upper section.

9 Claims, 11 Drawing Sheets

(58) Field of Classification Search
USPC ..... 2/421, 416, 417, 418, 419, 7, 8.1, 8.2, 2/8.3, 8.4, 8.5, 8.6, 8.7, 8.8
See application file for complete search history.

(56) References Cited

U.S. PATENT DOCUMENTS

| | | | | |
|---|---|---|---|---|
| 3,028,602 | A | 4/1962 | Miller | |
| 4,021,858 | A * | 5/1977 | Neeld | A42B 3/08 2/9 |
| 5,121,508 | A | 6/1992 | Grilliot et al. | |
| 5,483,699 | A | 1/1996 | Pernicka et al. | |
| 5,694,649 | A | 12/1997 | Hefling et al. | |
| 5,815,847 | A | 10/1998 | Holden, Jr. | |
| 5,898,950 | A | 5/1999 | Spyrou et al. | |
| 5,953,761 | A | 9/1999 | Jurga et al. | |
| 6,189,156 | B1 | 2/2001 | Loiars | |
| 6,298,497 | B1 | 10/2001 | Chartrand | |
| 6,865,752 | B2 | 3/2005 | Udelphofen et al. | |
| 6,968,575 | B2 | 11/2005 | Durocher | |
| 7,159,249 | B2 | 1/2007 | Dennis et al. | |
| D557,460 | S * | 12/2007 | Jourde | D29/108 |
| D628,347 | S | 11/2010 | Chen | |
| 7,870,617 | B2 | 1/2011 | Butler | |
| 7,908,678 | B2 | 3/2011 | Brine, III et al. | |
| 7,954,178 | B2 | 6/2011 | Durocher et al. | |
| 8,056,150 | B2 * | 11/2011 | Stokes | A42B 3/145 2/418 |
| 8,156,574 | B2 | 4/2012 | Stokes et al. | |
| 8,856,973 | B2 | 10/2014 | Jourde et al. | |
| 9,226,539 | B2 | 1/2016 | Beauchamp et al. | |
| 9,781,966 | B2 | 10/2017 | Brine, III et al. | |
| 10,709,193 | B2 * | 7/2020 | Mustac | A42B 3/08 |
| 2004/0040073 | A1 | 3/2004 | Morrow et al. | |
| 2008/0163410 | A1 | 7/2008 | Udelhofen | |
| 2013/0298316 | A1 * | 11/2013 | Jacob | A42B 3/12 2/414 |
| 2014/0259315 | A1 | 9/2014 | Durocher | |
| 2015/0033455 | A1 * | 2/2015 | Beauchamp | A42B 3/127 2/421 |
| 2015/0272258 | A1 * | 10/2015 | Preisler | G01L 1/04 2/412 |
| 2016/0324247 | A1 | 11/2016 | Warmouth et al. | |
| 2017/0006951 | A1 | 1/2017 | Venturini et al. | |
| 2017/0120134 | A1 | 5/2017 | Warmouth et al. | |
| 2017/0216707 | A1 * | 8/2017 | Mustac | A42B 3/205 |
| 2017/0291096 | A1 | 10/2017 | Melofchik et al. | |
| 2017/0311669 | A1 | 11/2017 | Morin et al. | |
| 2018/0140037 | A1 * | 5/2018 | Frieder, Jr. | B32B 3/12 |

OTHER PUBLICATIONS

Office Action from corresponding Canadian Application No. 2,947,199 dated Dec. 29, 2022.

* cited by examiner

GOALIE HELMET

FIELD OF DISCLOSURE

The present disclosure generally relates to a goalie helmet and components thereof.

BACKGROUND

The protective face and head gear worn by ice hockey goalies has evolved over the years, with the primary objective being to increase the safety and well-being of the player. The earliest goalies simply wore face masks for protection from hockey sticks and flying pucks. Gradually, goalie masks which protected both the face and the head were accepted. And this type of mask, which utilizes various designs, is routinely worn by most hockey goalies.

However, the commonly worn mask, exemplified by mask H in FIG. 1. has a number of distinct disadvantages. For instance, this mask, a rear view of which is shown in the FIG. 1, is configured with an open back, enclosed solely by a back plate BP, rigidly connected by straps or other means to the rear of the mask, This configuration permits only limited, if any, adjustment within the mask. As a result, such a mask often does not fit properly. This causes movement and instability of the head within the mask and the increased possibility of head injury. Improper mask fit is also uncomfortable, due to shifting of the head within the mask, especially during sudden and active movements. These prior masks also restrict airflow and circulation within the mask, resulting in overheating and additional discomfort.

SUMMARY

It is thus the object of the present invention to provide a helmet for a goalie which addresses the limitations and disadvantages of known goalie masks. This and other objectives are accomplished by the present invention, a goalie helmet comprising a head protective outer shell which is configured to circumscribe the head of a goalie. The shell has an interior space in which a floating head framing member is located for cradling and supporting the head of the goalie. The head framing member is located in spaced relation to and a given distance from the back or rear section of the shell of the helmet. Attachment devices, such as straps, connect the head framing member to the helmet in spaced relation to and a distance away from the rear section. The helmet also includes a. unique chin cup support bracket located on its lower front section. A specifically designed chin cup is configured to be remove ably positioned and secured onto the bracket. The chin cup can simply and easily be replaced on the bracket when it becomes worn.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

In some embodiments, a helmet for a goalie is described herein. The helmet includes a head protective outer shell, a chin cup support bracket, and a shock membrane. The head protective outer shell defines an interior space. The head protective outer shell is configured to completely circumscribe the head of a goalie. The head protective outer shell includes an exterior portion and in interior portion. The exterior portion includes an exterior lower section and an exterior upper section. The exterior upper section is curved. The interior portion is opposite the exterior portion. The interior portion includes an interior lower section and an interior upper section. The chin cup support bracket is secured to the interior lower section. The chin cup support bracket includes dual arm members configured to interface with a removable chin cup. The chin cup support bracket is secured to the interior lower section via one or more screws. The shock membrane is coupled with the interior upper section. The shock membrane includes a honeycomb design adapted to match a curvature of the exterior upper section and the interior upper section.

In some embodiments, a helmet for a goalie is described herein. The helmet includes a head protective outer shell and a shock membrane. The head protective outer shell defines an interior space. The head protective outer shell is configured to completely circumscribe the head of a goalie. The head protective outer shell includes an exterior portion and in interior portion. The exterior portion includes an exterior lower section and an exterior upper section. The exterior upper section is curved. The interior portion is opposite the exterior portion. The interior portion includes an interior lower section and an interior upper section. The shock membrane is coupled with the interior upper section. The shock membrane includes a honeycomb design adapted to match a curvature of the exterior upper section and the interior upper section. The interior lower section is adapted to receive a chin cup support bracket that includes dual arm members configured to interface with a removable chin cup. The chin cup support bracket is securable to the interior lower section via one or more screws.

In some embodiments, a helmet for a goalie is disclosed herein. The helmet includes a head protective outer shell, a chin cup support bracket, a shock membrane, and a facemask. The head protective outer shell defines an interior space. The head protective outer shell is configured to completely circumscribe the head of a goalie. The head protective outer shell includes an exterior portion, an interior portion, and a window. The exterior portion includes an exterior lower section and an exterior upper section. The exterior upper section is curved. The interior portion is opposite the exterior portion. The interior portion includes an interior lower section and an interior upper section. The window is formed in the head protective outer shell. The window is surrounded by the exterior lower section, the exterior upper section, the interior lower section, and the exterior upper section. The chin cup support bracket secured to the interior lower section. The chin cup support bracket includes dual arm members configured to interface with a removable chin cup. The chin cup support bracket is secured to the interior lower section via one or more screws. The shock membrane is coupled with the interior upper section. The shock membrane includes a honeycomb design adapted to match a curvature of the exterior upper section and the interior upper section. The facemask overlays the window. The facemask is secured to the head protective outer shell using the one or more screws securing the chin cup support bracket to the interior lower section.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrated only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 1:
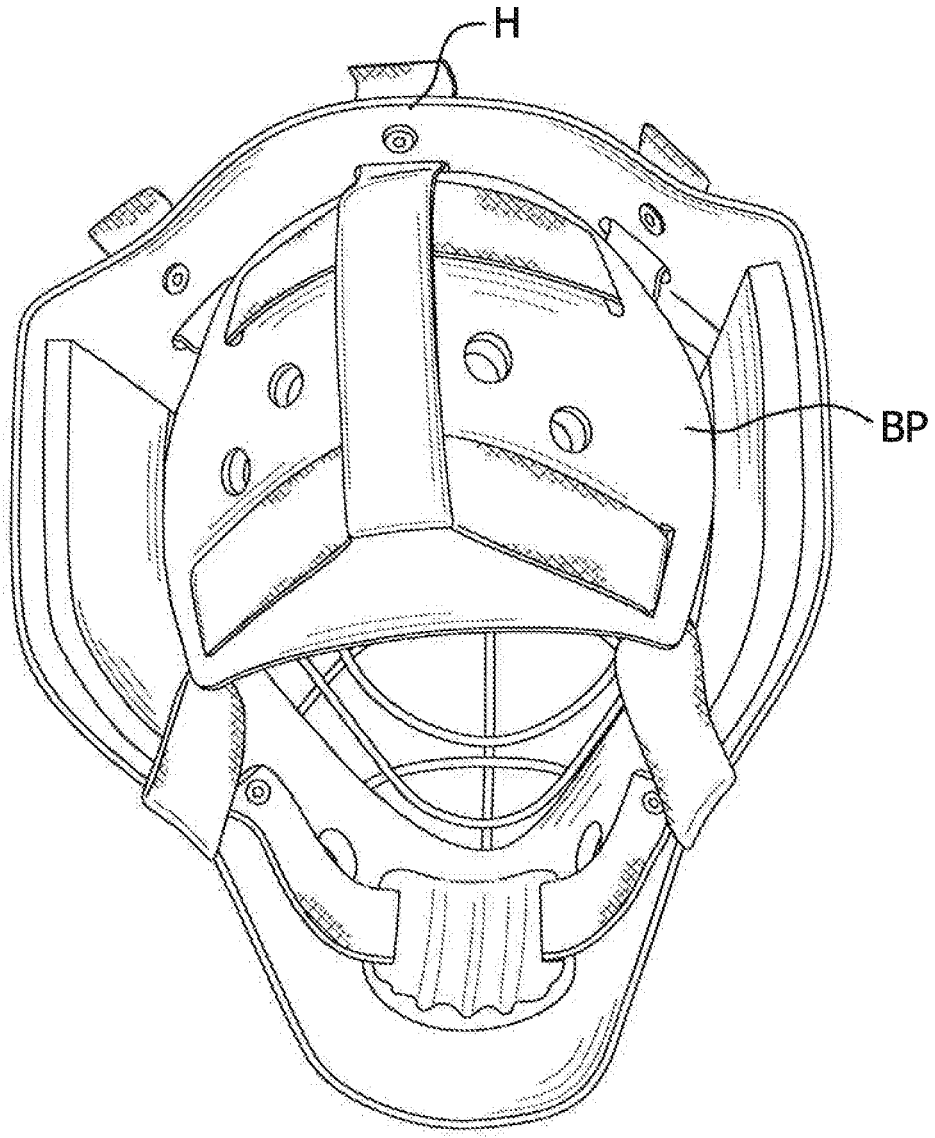
FIG. 1 PRIOR ART
FIG. 1 is a rear view of the prior art, a common goalie mask, according to example embodiments.

Conventionally, masks, specifically goalie masks, include at least two components: a mask shell and a back plate. Such design suffered from a variety of limitations, most prominent of which is being unable to maintain head stability when the mask is worn. As concussions and chronic traumatic encephalopathy (CTE) have become more prominent in sports, there has been high importance placed on developing technology and products that minimize or reduce the likelihood of sustaining such head injuries.

One or more techniques described herein improve upon the conventional goalie mask design by providing a goalie helmet that is formed from a unitary construction. In other words, one or more techniques provided herein provide a goalie helmet that includes a shell that completely surrounds a head of a wearer (e.g., a goalie). In this manner, the goalie helmet provided herein eliminates use of the two component mask shell and back plate of conventional goalie mask systems. In this manner, the goalie helmet described herein provides improved head stability when the helmet is worn.

To further improve head stability and impact absorption, the goalie helmet includes a variety of improvements over conventional systems.

First, the goalie helmet described herein provides a floating head framing member that is elliptically shaped to conform to the back of the head of the wearer. In this manner, the floating head framing member is configured to cradle and provide rigid support to the head.

Second, the goalie helmet described herein provides an improved mechanism for maintaining head stability through the use of an improved chin cup bracket. As provided herein, conventional goalie masks allow for use of a chin cup. However, such chin cups are only secured to the goalie mask using a strap design. When in use, this strap design is subject to movement or wiggling, which can contribute to head instability. The chin cup bracket described herein eliminates the possibility for chin cup movement or wiggling by being securely fastened to the shell of the goalie helmet. The chin cup bracket further includes dual arm members configured to receive a removable chin cup.

Third, the goalie helmet described herein includes a curved front portion. Conventional goalie masks typically include a generally flat front surface. In this manner, conventional goalie masks are not tuned to more efficiently deflect objects (e.g., pucks) upon impact. By increasing the angle of curvature for the front portion of the goalie helmet, such as in a manner that generally conforms to the head of a wearer, the goalie helmet provides a curved surface that is better adapted to reflect objects upon impact.

Fourth, the goalie helmet described herein includes a shock membrane. The shock membrane may be positioned in the interior of the goalie helmet, opposite the curved front portion. With such placement, the shock membrane is adapted to provide additional protection between the interior of the helmet and the upper head of a wearer. The shock membrane includes a honeycomb design which not only absorbs impact better than conventional padding materials but is also pliable enough to conform to the curvature of the curved front portion. In this manner, the shock membrane remains flush with the helmet shell.

Goalie helmet 1 of the present invention is a major improvement over existing commonly worn helmets. FIGS. 2-6 show various views of helmet 1. For the sake of simplicity and clarity of invention, helmet 1 is shown without the protective padding which normally would be found within a goalie's helmet.

Figure 3:
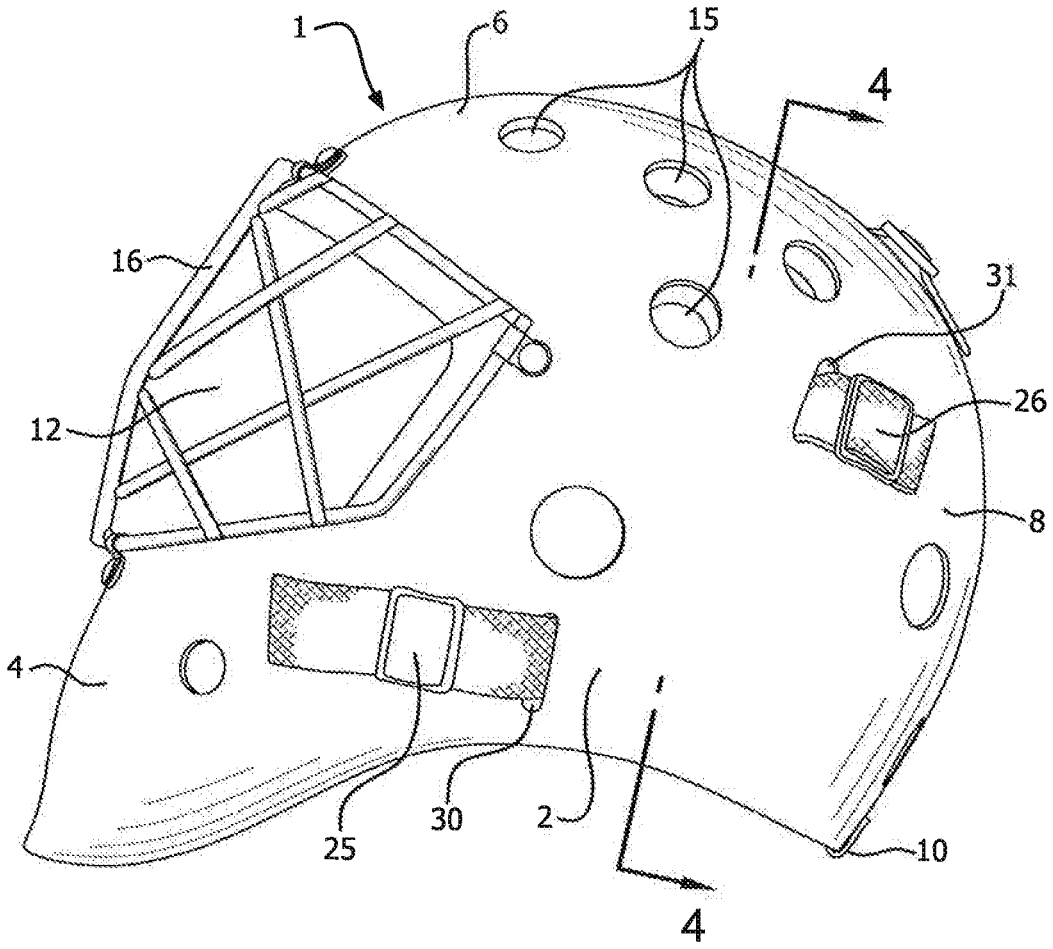
FIG. 3 is an elevation view of the goalie helmet of the present invention, according to example embodiments.

With particular reference to FIG. 3, helmet 1 comprises head protective outer shell 2 designed to circumscribe the goalie's head. Shell 2 comprises lower front section 4, top section 6, and rear section 8, extending from the top section down to the bottom 10 of helmet 1, which approximates where the neck area of the wearer. Lower front section 4, top section 6, and rear section 8 of shell 2 encloses interior space 14 of helmet 1. A plurality of air circulating holes 15 extend through shell 2. Front window 12, protected by cage 16, is provided at the front of helmet 1.

Floating head framing member 20 is elliptically shaped to conform to the back of the head of the wearer. Its purpose is to cradle and provide rigid support to the head. Framing member 20 is advantageously located within interior space 14, in spaced relation to and a given distance away from rear section 8 of shell 2. Framing member 20 is maintained in this position, in spaced relation to and a given distance away from rear section 8, by attachment means in the form of a plurality of length adjustable straps 22, 23, 24, 25 and 26 which extend between the framing member and shell 2, through openings 27, 28, 29, 30 and 31 in the shell. The adjustability of the straps provides the means to adjust the position of framing member 20 within interior space 14, in order to accommodate the position and comfort of the head of the wearer. There is thus increased support and stability for the head, thereby vastly increasing the protection and safety of the wearer.

Of significance is that strap 22, the top strap which secures framing member 20, comprises a non-elastic, non-stretchable material. This is critical to maintaining the position of the framing member, as an elastic material would allow helmet 1 to unduly move about and droop over the wearer's head. In fact, the non-elastic nature of strap 22 allows framing member 20 to pivot back and forth, almost like a hinge, while being worn by the goalie.

It is further noted that openings 27, 28, 29, 30 and 31 are large enough to allow them to be unsnapped and removed, without being cut, when removal of helmet 1 is necessary, should the goalie be injured and unconscious.

The positioning of framing member 20, a spaced apart distance from rear section 8 of shell 2 and the control opening of the framing member also allow for increased air flow around the wearer's head. Overheating is greatly reduced, enhancing the comfort of the wearer.

Figure 2:
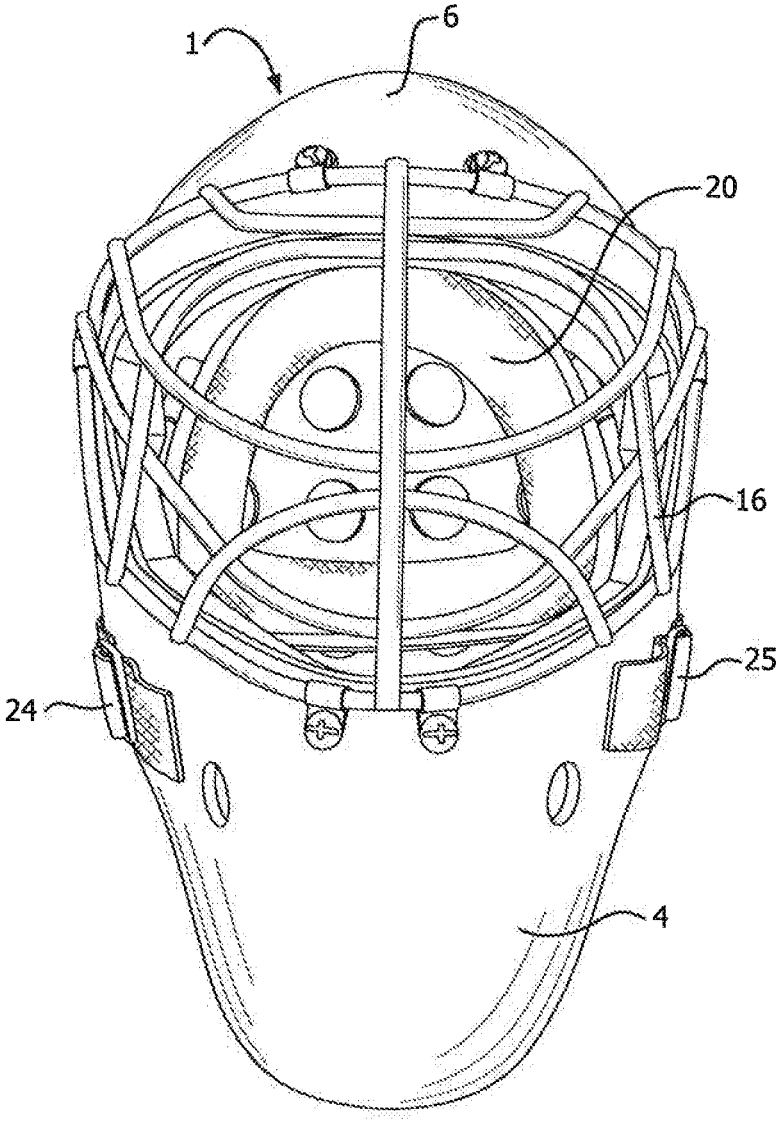
FIG. 2 is a front perspective view of the goalie helmet of the present invention, according to example embodiments.

Chin cup support bracket 40 is attached by means of screws 42 and 43 to the interior of lower front section 4 of shell 2. As seen in FIG. 2, these screws also secure the lower section of cage 16 to shell 2, by means of cage clips. Chin cup support bracket 40 comprises base member 44 and dual arm members 46 and 48, upstanding from the base member. Chin cup 50 is designed to be removably positioned and maintained within chin cup support bracket 40. Slots 52 and 54 are located through chin cup 50. Arm members 46 and 48 are configured to extend through slots 52 and 54 in order to maintain chin cup 50 within chin cup support bracket 40. In this way chin cup 50 can easily and readily be removed from and replaced on chin cup support bracket 40, when the chin cup becomes worn or otherwise ineffective. The use of chin cup support bracket 40 and its corresponding chin cup 50 serves to further eliminate play by comfortably stabilizing the wearer's chin within helmet 1.

Figure 5:
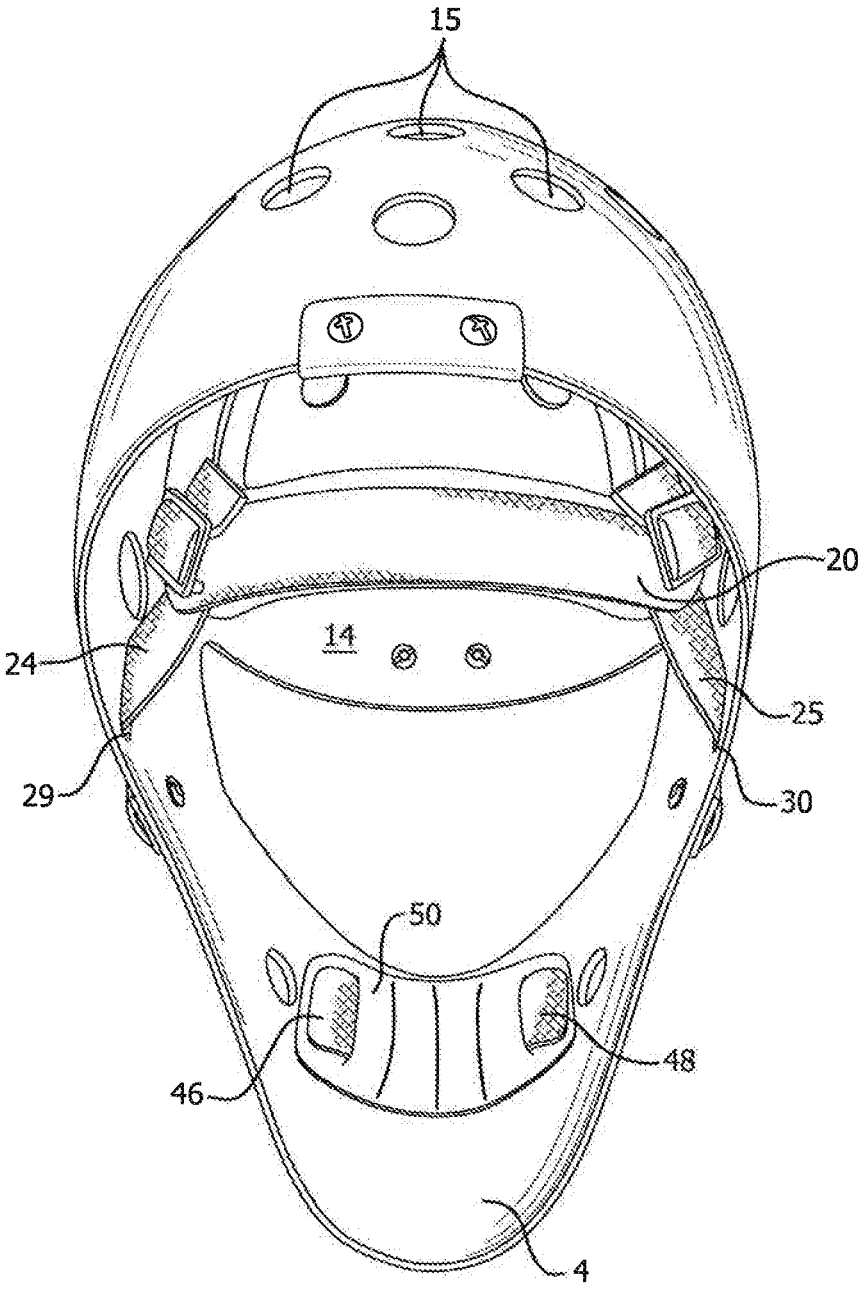
FIG. 5 is a rear perspective view of the goalie helmet of the present invention, according to example embodiments.

In some embodiments, helmet 1 may include a head protective outer shell 2 that defines an interior space 14. The head protective outer shell 2 may be configured to completely circumscribe the head of a goalie. As shown in FIG. 3, head protective outer shell 2 may include a front portion having a lower front section and an upper front section, a rear portion comprising a lower rear section and an upper rear section, and a top portion adjacent to the front portion and the rear portion. As shown in FIG. 1, the front portion and rear portion are on opposing sides of the top portion. As illustrated in FIGS. 2, 3, and 5, the lower front section, the upper front section, the lower rear section, the upper rear section, and the top section are of unitary construction, and wherein the lower front section of the front portion extends farther from the top portion than the lower rear section of the rear portion.

In some embodiments, helmet 1 may further include a window 12 formed in the front portion. As shown in FIGS. 2, 3, and 5 window 12 may be completely surrounded on all sides by at least the lower front section and the upper front section.

Figure 4:
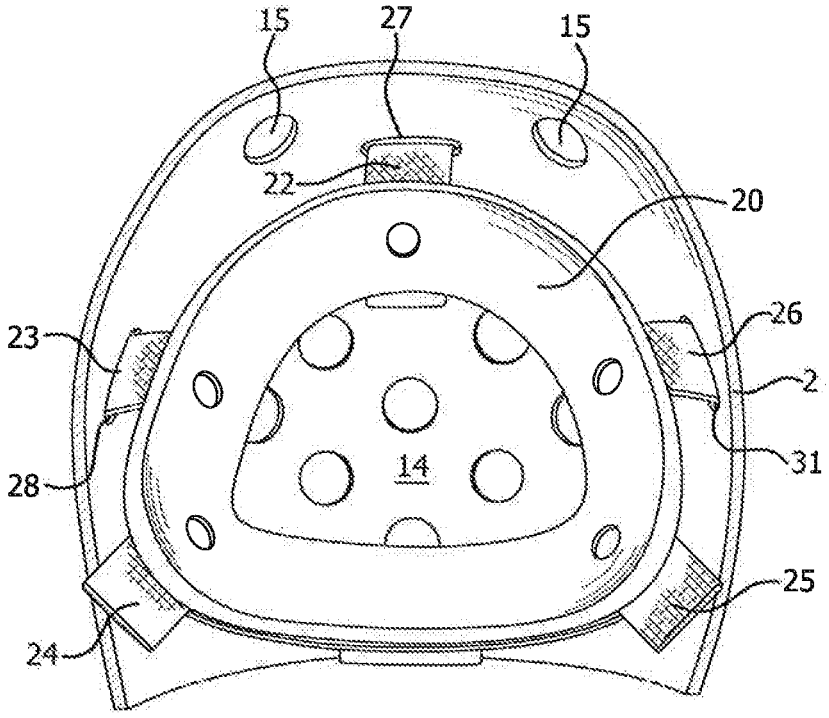
FIG. 4 is a cross-sectional view taken from FIG. 3, according to example embodiments.

In some embodiments, helmet 1 may further include an elliptical, free, floating head framing member 20 to be worn by the goalie and shaped to conform to the back of the head of the goalie for cradling and rigidly supporting the head. As shown in FIGS. 4 and 5, head framing member 20 may be located within interior space 14 and entirely in spaced relation to and a given distance away from the rear section portion. As clearly shown in FIGS. 4 and 5, in some embodiments, head framing member 20 may be positioned substantially vertically within interior space 14.

In some embodiments, helmet 1 may further include attachment means 22-26 located within interior space 14 coupling the head framing member 20 to the head protective outer shell 2 and for suspending the head framing member 20 within the interior space 14 in said spaced relation to and said given distance away from the rear portion. As shown in FIGS. 4 and 5, head framing member 20 may be positioned substantially vertically within the interior space. As shown in FIGS. 4 and 5, attachment means 22-26 may include an adjustable strap member extending from the upper rear section of the head protective outer shell to the head framing member and a plurality of adjustable strap members extending from the rear portion of the head protective outer shell to the head framing member to maintain the head framing member suspended within the interior space.

As shown in FIGS. 4 and 5. head framing member 20 may be configured to pivot between two or more (along a range of positions within the interior space.

In some embodiments, such as that shown in FIGS. 3 and 5, a plane may pass vertically through a center of the head protective outer shell 2 and the front portion.

In some embodiments, such as that shown in FIG. 2, window 12 and the head framing member 20 may be at least partially aligned along an axis passing through a center of the head protective outer shell 2.

In some embodiments, such as that shown in FIGS. 2, 5, and 6, front portion may further include facemask receiving holes selectively positioned at least partially above and partially below the window. The facemask receiving holes may be configured to receive one or more fasteners coupling a facemask to front portion.

In some embodiments, such as that shown in FIG. 3, a first distance from the upper rear section to the lower rear section is less than a second distance from the upper front section to the lower front section.

Figure 6:
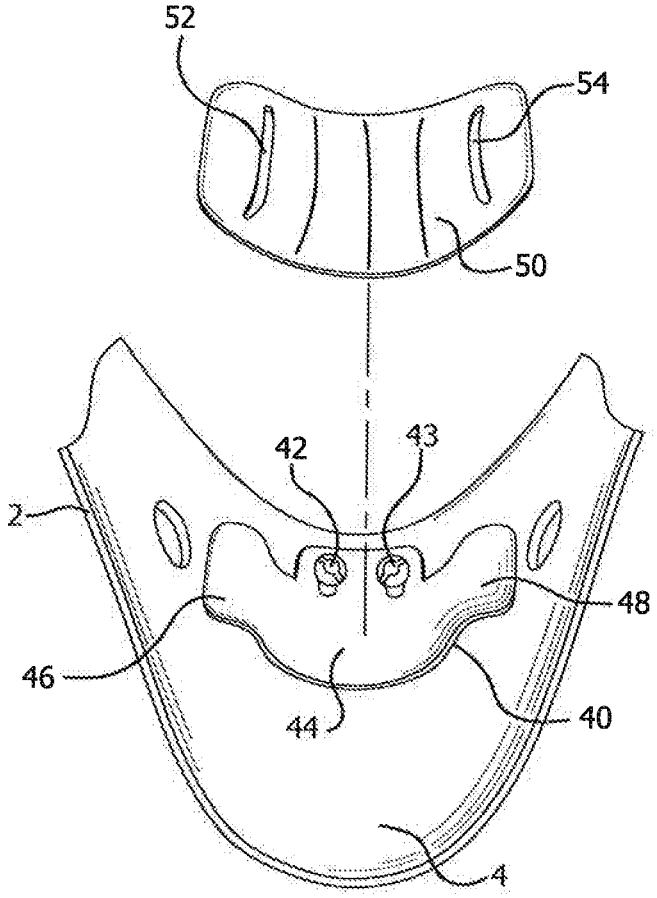
FIG. 6 is an exploded, detailed view of the chin cup support bracket and chin cup of the helmet of the present invention, according to example embodiments.

In some embodiments, such as that shown in FIGS. 5 and 6, helmet 1 may include a chin cup support receiving surface positioned on an internal surface of the lower front section.

In some embodiments, such as that shown in FIGS. 5 and 6, bracket member may be secured to the internal surface of the lower front section via one or more openings formed below the window.

In some embodiments, such as that shown in FIGS. 2 and 5, one or more openings formed below the window may be configured to receive one or more fasteners coupling the chin cup to the front portion.

In some embodiments, such as that shown in FIGS. 2, 4, and 5 head framing member 20 may be substantially parallel with the rear portion.

In some embodiments, such as that shown in FIGS. 2, 4, and 5, head framing member 20 may be positioned substantially closer to the rear portion than the front portion.

Referring to FIG. 6, helmet 1 may further include chin cup support bracket 40. Chin cup support bracket 40 may be attached to helmet 1 via one or more coupling mechanisms such as, screws 42 and 43. For example, as illustrated, chin cup support bracket 40 may be attached to an interior of lower front section 4 of shell 2. Such coupling mechanisms provide an improvement over conventional chin cup support brackets. For example, conventional mask designs typically rely on a strap that loops around an opening formed in the mask shell. Such strap mechanism suffers from a few limitations. For example, because conventional systems utilize a strap system to secure the chin cup, the chin cup is vulnerable to movement when the mask is worn. As such, the chin cup can wiggle and become displaced during competition, which could leave a wearer's chin vulnerable to impact. Chin cup support bracket 40 eliminates that possibility for chin cup movement by replacing the traditional strap mechanism with screws 42 and 43 that directly couple chin cup support bracket 40 to helmet 1. In this manner, chin cup support bracket 40 is secure and can no longer move or wiggle out of place when worn, thus continually protecting a wearer's chin from impact.

Figure 7:
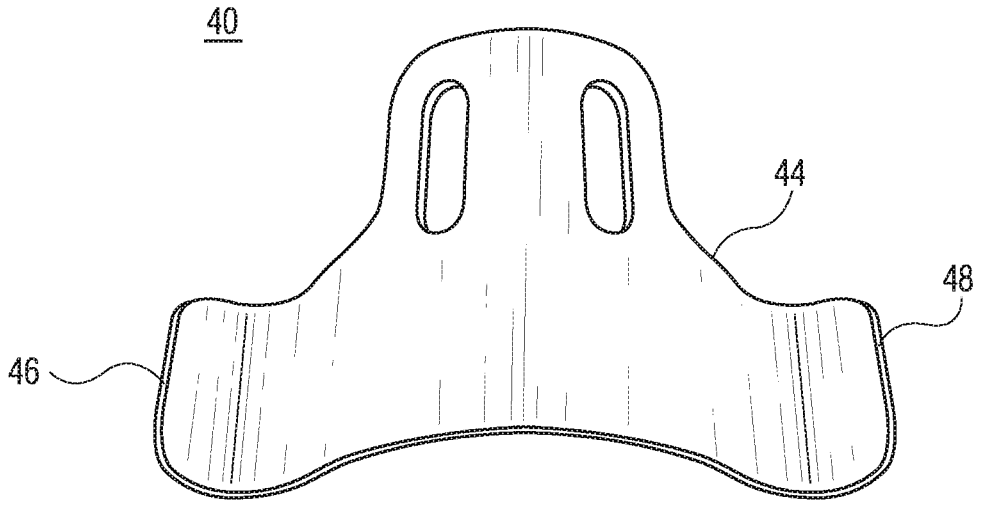
FIG. 7 illustrates chin cup support bracket, according to example embodiments.

FIG. 7 illustrates chin cup support bracket 40, according to example embodiments. As shown, chin cup support bracket 40 includes a base member 44 and dual arm members 46 and 48. In some embodiments, base member 44 and dual arm members 46 and 48 may be formed form an integrated body. In some embodiments, chin cup support bracket 40 may be formed from a molded pliable material (e.g., plastic).

Figure 8:
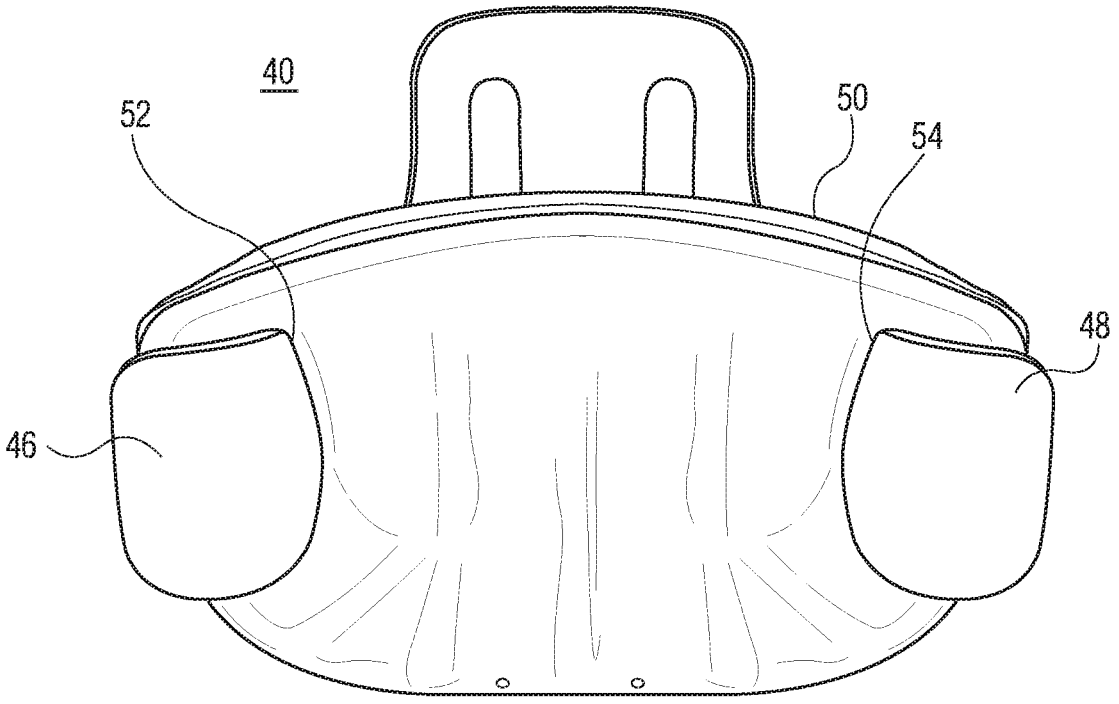
FIG. 8 illustrates chin cup support bracket coupled with chin cup, according to example embodiments.

FIG. 8 illustrates chin cup support bracket 40 coupled with chin cup 50, according to example embodiments. As shown, chip cup 50 may include one or more slots 52 and 54 formed therein. Slots 52 and 54 may interface with dual arm members 46 and 48 of base member 44. As discussed above, conventionally, masks did not include a chin cup support bracket. Instead, conventional masks rely on a strap system by which a chin cup was coupled to the mask shell via one or more straps. Chin cup support bracket 40 improves upon conventional systems by providing a means for coupling a chin cup 50 thereto, such that movement of chin cup 50 is eliminated. For example, by securing chin cup support bracket 40 to helmet 1 via screws 42 and 43 and coupling chin cup 50 with chin cup support bracket 40 via slots 52 and 54 and arm members 46 and 48, chin cup 50 may be secured and not subject to movement or wiggling.

In some embodiments, screws 42 and 43 for coupling chin cup support bracket 40 to helmet 1 may also be used to secure the facemask to helmet 1.

Figure 9:
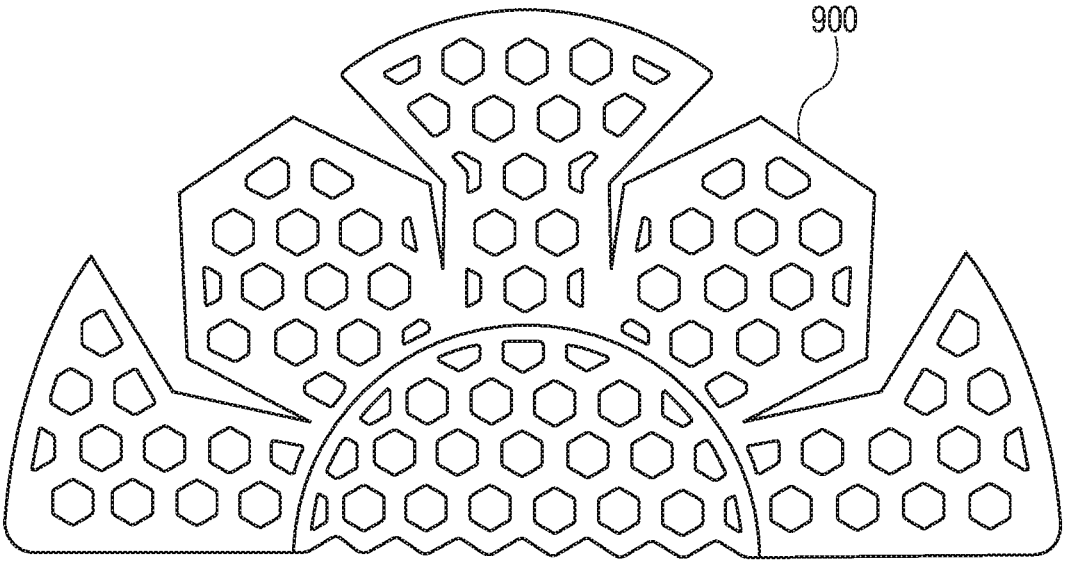
FIG. 9 illustrates a shock membrane for use with helmet, according to example embodiments.

FIG. 9 illustrates a shock membrane 900 for use with helmet 1, according to example embodiments. Shock membrane 900 may be formed from a pliable material (e.g., medium density rubber). Shock membrane 900 may be coupled with an inside wall of helmet 1. In this manner, shock membrane 900 may act as a buffer separating helmet 1 from additional padding.

As illustrated, shock membrane 900 may have a honeycomb design. Honeycomb design may allow shock membrane 900 to not only absorb shock better due to its sponge-like properties, but also allows shock membrane 900 to be more pliable. In this manner, shock membrane 900 may be manipulated to match a curvature or contour of a surface.

Referring to FIG. 3, as illustrated, top section 6 is curved such that an object can deflect off top section 6 easier compared to traditional elements that do not include a curved front portion. For example, by increasing the angle of curvature for top section 6, such as in a manner that generally conforms to the head of a wearer, helmet 1 may provide a curved surface that is better adapted to reflect objects upon impact. Due to the curvature of top section 6, conventional padding on the interior of helmet 1 may become spaced apart from shell 2. This may be attributed to the fact that padding may be formed from a material that is not as easily pliable. In this manner, an object may come into contact with top section 6 during a time in which the padding on the interior of helmet 1 is not flush against shell 2. As a result, helmet 1 may not absorb the impact of such collision. To account for this, shock membrane 900 may be used in conjunction with additional padding to ensure that the shock from colliding objects is absorbed.

Figure 10A:
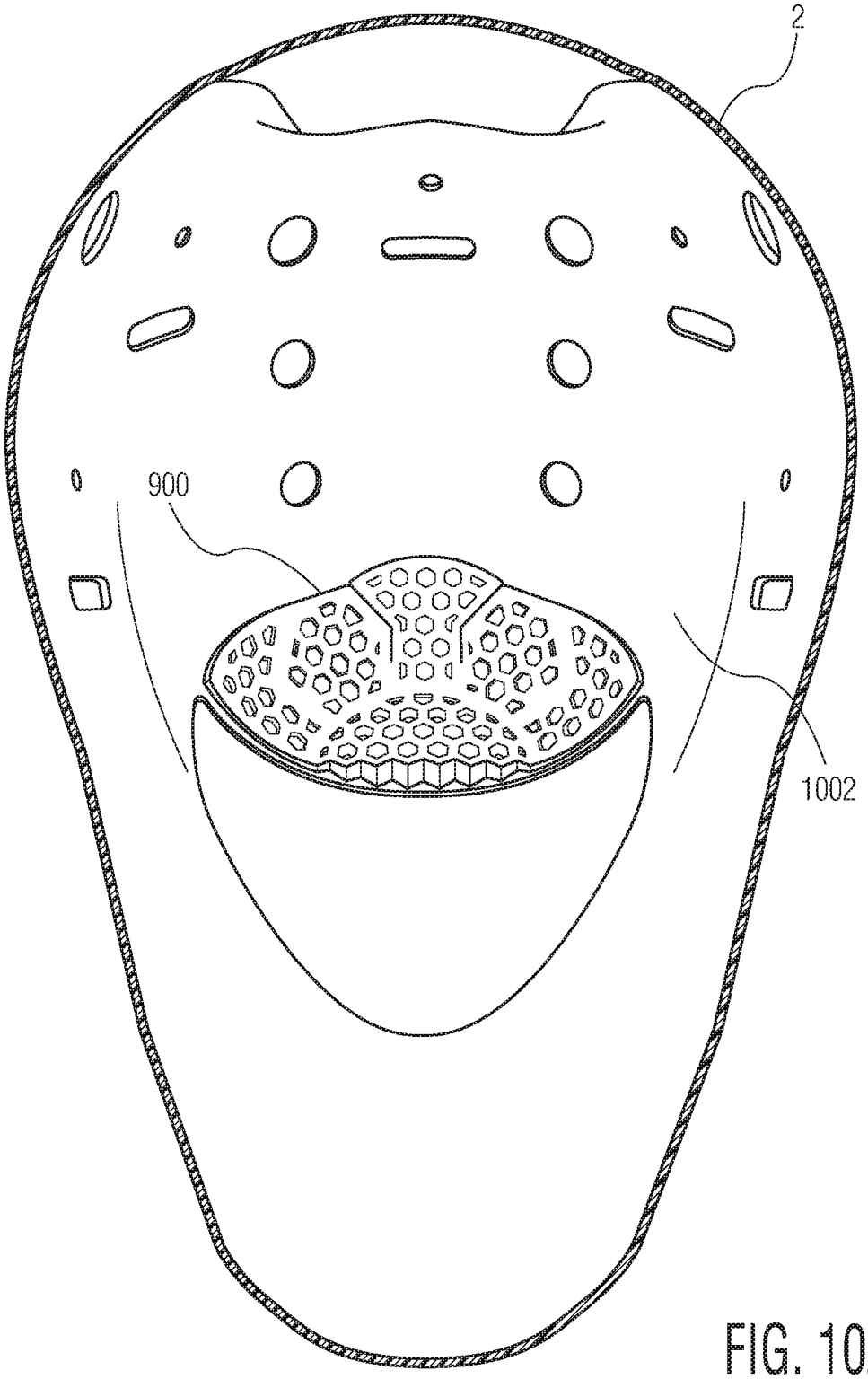
FIG. 10A illustrates a shock membrane positioned within an interior of helmet, according to example embodiments.

FIG. 10A illustrates shock membrane 900 positioned within an interior of helmet 1, according to example embodiments. As shown, shock membrane 900 may interface with interior portion 1002. Interior portion 1002 may be opposite top section 6. Because shock membrane 900 is formed from a pliable material and includes a honeycomb design, shock membrane 900 may be able to match the contour or curvature of top section 6 and interior portion 1002. In this manner, shock membrane 900 may be flush against interior portion 1002. With such placement, shock membrane 900 may be adapted to provide additional protection between interior portion 1002 and the upper head of a wearer.

In some embodiments, shock membrane 900 may be coupled with interior portion 1002 using an adhesive (e.g., glue, cement, paste, etc.).

Figure 10B:
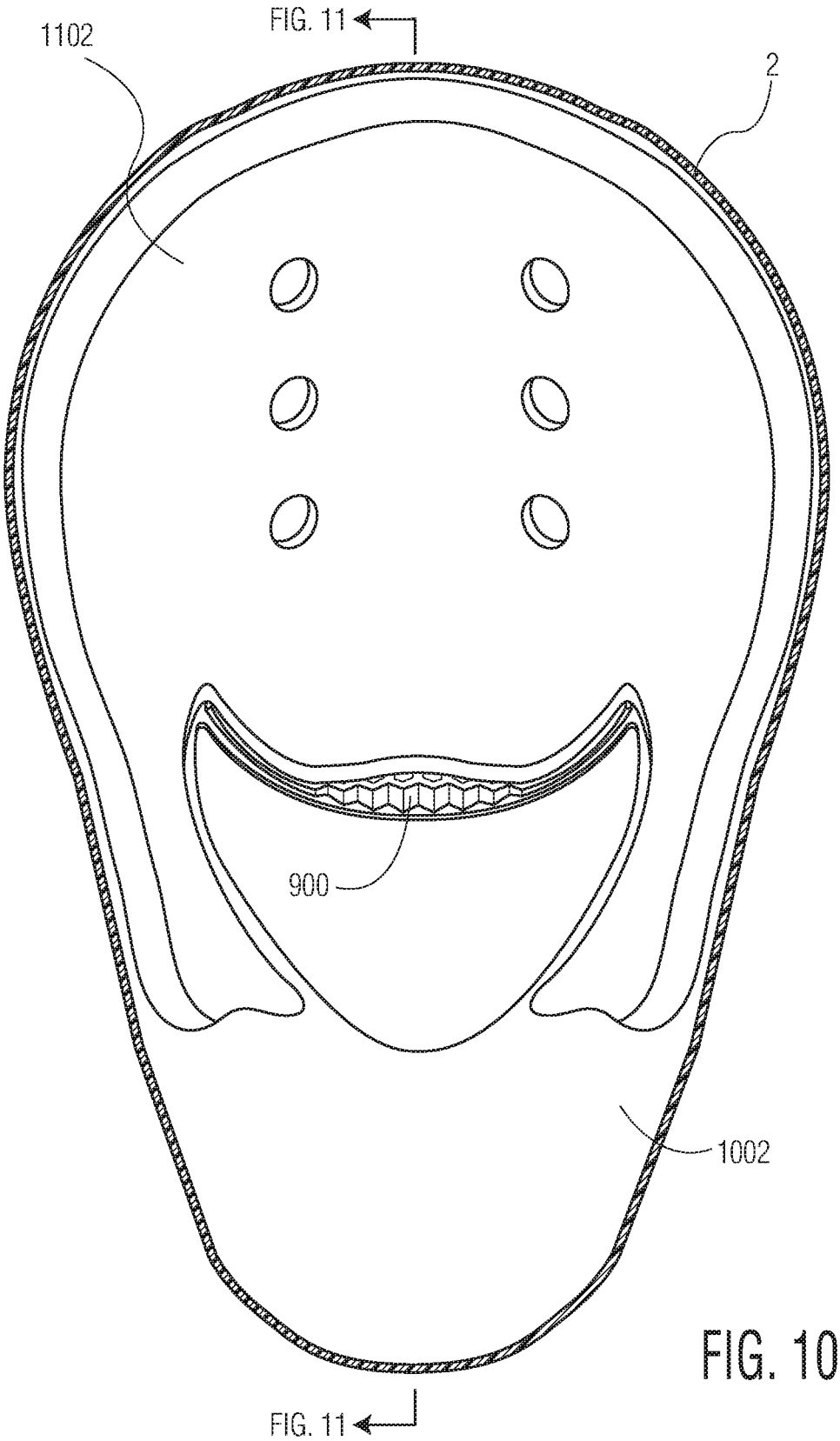
FIG. 10B illustrates padding and a shock membrane positioned within an interior of helmet, according to example embodiments.

FIG. 10B illustrates padding 1102 and shock membrane 900 positioned within an interior of helmet 1, according to example embodiments. As illustrated, padding 1102 may be positioned in interior helmet 1. In some embodiments, padding 1102 may be at least partially covering shock membrane 900.

Figure 11:
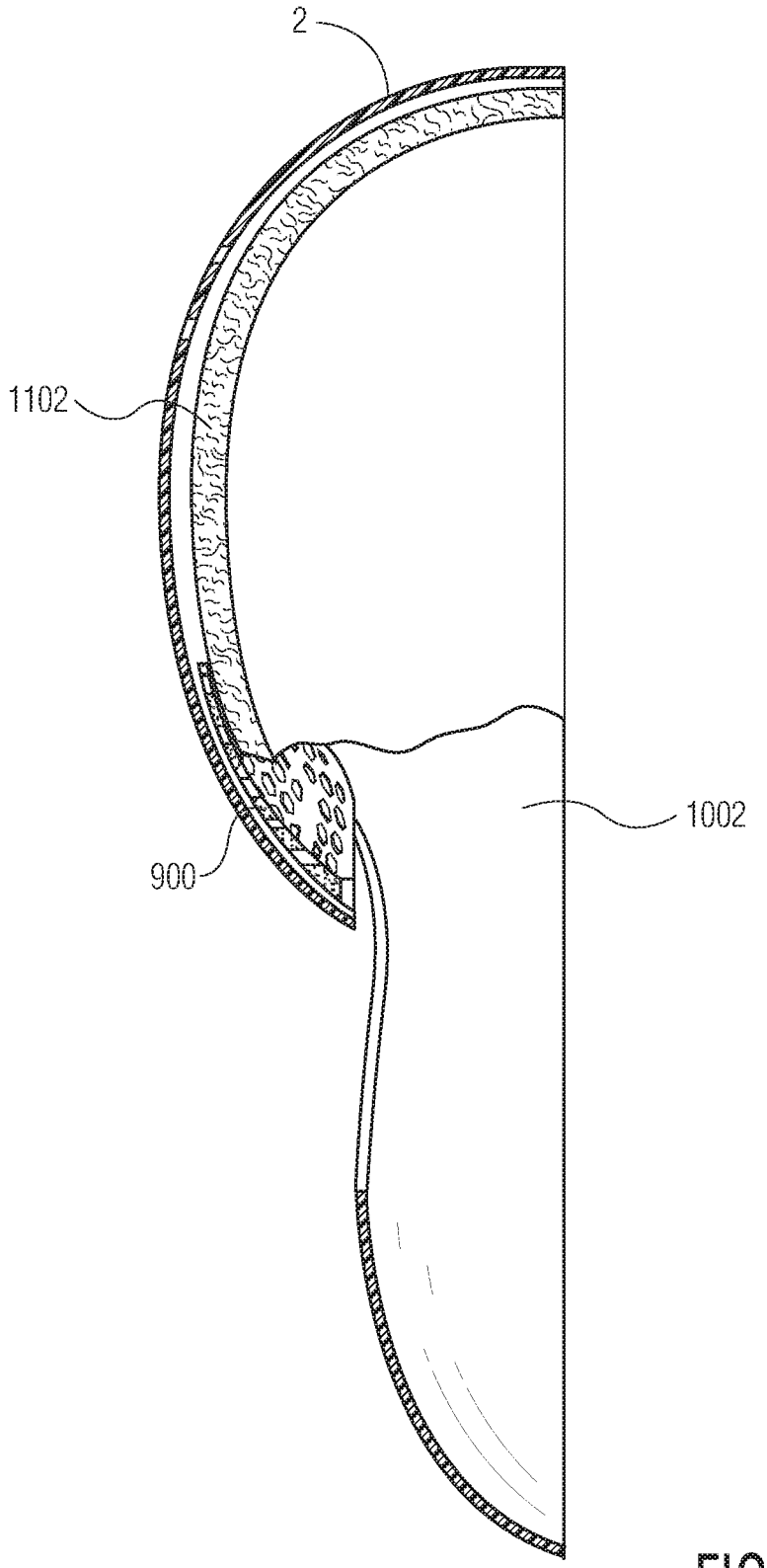
FIG. 11 is a cross sectional view of helmet, according to example embodiments.

FIG. 11 is a cross sectional view of helmet 1, according to example embodiments. As illustrated, FIG. 11 provides shell 2, shock membrane 900, and padding 1102. Shock membrane 900 may be coupled with shell 2 in interior portion 1002. Padding 1102 may be coupled with at least one of shock membrane 900 and/or shell 2. For example, padding 1102 may be coupled with shock membrane 900 using an adhesive (e.g., glue, cement, paste, etc.). In another example, padding 1102 may be coupled with shell 2 using an adhesive (e.g., glue, cement, paste, etc.). In another example, padding 1102 may be coupled at least partially with shock membrane 900 and at least partially with shell 2 using an adhesive.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A helmet for a goalie comprising:

a head protective outer shell defining an interior space, the head protective outer shell comprising a single piece shell configured to completely circumscribe a head of a goalie, said head protective outer shell comprising:

an exterior portion comprising an exterior lower section and an exterior upper section, wherein the exterior upper section is curved, an interior portion opposite the exterior portion comprising an interior lower section and an interior upper section, and a window formed in the head protective outer shell, wherein the window is surrounded by the exterior lower section, the exterior upper section, the interior lower section, and the interior upper section; and a strapless chin cup support bracket secured to the interior lower section below the window, the strapless chin cup support bracket comprising dual arm members configured to interface with a removable chin cup and secure the removable chin cup to the strapless chin cup support bracket, wherein the strapless chin cup support bracket is secured to the interior lower section via one or more screws.

2. The helmet of claim 1, further comprising:

an elliptical, free, floating head framing member shaped to conform to a back of the head of the goalie, the head framing member licated within the interior space.

3. The helmet of claim 1, further comprising:

padding positioned in the interior space.

4. The helmet of claim 1, wherein the strapless chin cup support bracket is formed from a molded pliable material.

5. The helmet of claim 1, wherein the exterior upper section comprises a convex curvature.

6. The helmet of claim 1, wherein the exterior upper section is curved to deflect objects upon impact.

7. A helmet for a goalie comprising:

a head protective outer shell defining an interior space, the head protective outer shell comprising a single piece shell configured to completely circumscribe a head of a goalie, said head protective outer shell comprising:

an exterior portion comprising an exterior lower section and an exterior upper section, wherein the exterior upper section is curved, an interior portion opposite the exterior portion comprising an interior lower section and an interior upper section, and a window formed in the head protective outer shell, wherein the window is surrounded by the exterior lower section, the exterior upper section, the interior lower section, and the interior upper section;

a strapless chin cup support bracket secured to the interior lower section below the window, the strapless chin cup support bracket comprising dual arm members configured to interface with a removable chin cup and secure the removable chin cup to the strapless chin cup support bracket, wherein the strapless chin cup support bracket is secured to the interior lower section via one or more screws; and a facemask overlaying the window, the facemask secured to the head protective outer shell using the one or more screws securing the strapless chin cup support bracket to the interior lower section.

8. The helmet of claim 7, further comprising:

an elliptical, free, floating head framing member shaped to conform to a back of the head of the goalie, the head framing member located within the interior space.

9. The helmet of claim 7, further comprising:

padding positioned in the interior space.

* * * * *